US007607568B2

(12) United States Patent
Hatakeyama et al.

(10) Patent No.: US 7,607,568 B2
(45) Date of Patent: Oct. 27, 2009

(54) FLEXIBLE BOARD FOR FORMING PACKAGE

(75) Inventors: Chie Hatakeyama, Tokyo (JP); Hiroshi Sato, Tochigi (JP)

(73) Assignee: Hoya Corporation, Tokyo (JP)

( * ) Notice: Subject to any disclaimer, the term of this patent is extended or adjusted under 35 U.S.C. 154(b) by 519 days.

(21) Appl. No.: 11/330,217

(22) Filed: Jan. 12, 2006

(65) Prior Publication Data

US 2006/0169758 A1 Aug. 3, 2006

(30) Foreign Application Priority Data

Jan. 28, 2005 (JP) ..... P2005-021862
Oct. 3, 2005 (JP) ..... P2005-290054

(51) Int. Cl.
*B65D 5/10* (2006.01)

(52) U.S. Cl. ..... 229/185; 229/156; 229/157

(58) Field of Classification Search ..... 229/117.04, 229/185, 110, 156, 157
See application file for complete search history.

(56) References Cited

U.S. PATENT DOCUMENTS 889,109 A * 5/1908 Davidson ..... 229/155
3,119,546 A * 1/1964 Wuerthner ..... 229/162.6
3,365,134 A * 1/1968 Oberreich ..... 229/153
3,374,937 A * 3/1968 Wilson ..... 229/152
4,817,796 A * 4/1989 Camillo et al. ..... 206/396
5,150,789 A * 9/1992 Bass ..... 206/396
5,529,186 A * 6/1996 Bass ..... 206/395

FOREIGN PATENT DOCUMENTS

JP 2000-103422 4/2000
JP 1253281 10/2005
JP 1253663 10/2005

OTHER PUBLICATIONS

English Language Abstract of JP 2000-103422.

* cited by examiner

*Primary Examiner*—Gary E Elkins
*Assistant Examiner*—Latrice Byrd
(74) *Attorney, Agent, or Firm*—Greenblum & Bernstein PLC

(57) ABSTRACT

A flexible board, for forming a package, comprises a body portion, a big bottom piece, a small bottom piece, a left-side bottom piece, and a right-side bottom piece. The body portion has a rear body piece, a left-side body piece, a front body piece, and a right-side body piece. The big bottom piece is connected to a lower side of the rear body piece. The small bottom piece is connected to a lower side of the front body piece, and has a strip piece, and first and second projecting pieces. The left-side bottom piece is connected to a lower side of the left-side body piece, and is formed with a cut-out section close to the first projecting piece. The right-side bottom piece is connected to a lower side of the right-side body piece, and is formed with a cut-out section close to the second projecting piece. The length of the insert piece is shorter than the distance between the first and second projecting pieces.

9 Claims, 11 Drawing Sheets

FLEXIBLE BOARD FOR FORMING PACKAGE

BACKGROUND OF THE INVENTION

1. Field of the Invention

The present invention relates to a package for packaging a commodity such as a camera.

2. Description of the Related Art

Conventionally, there is known a package, in which a commodity having a relatively heavy weight is placed, and the package has a box bottom called an "American Lock", as shown in Japanese Unexamined Patent Publication No. 2000-103422. The box bottom is easily formed by assembling a rear bottom piece, a left-side bottom piece, a front bottom piece, and a right-side bottom piece, so that an operation such as pasting or gluing is not necessary. When viewing the box bottom from the outside, the left-side bottom piece and the right-side bottom piece appear triangular, and the rear bottom piece and the front bottom piece appear trapezoidal, so that the two trapezoids appear to contact at the upper sides, and the oblique sides of the trapezoids appear to contact the oblique sides of the triangles (see FIG. 2 of JUPP No. 2000-103422).

The box bottom of the package described above will not easily open even when the central portion thereof is pressed from the inside, since the rear bottom piece, the left-side bottom piece, the front bottom piece, and the right-side bottom piece are engaged with each other. Thus, a relatively heavy commodity can be contained in the package.

Nevertheless, when information such as the product's serial number has to be indicated on the outer surface of the box bottom, since the conventional box bottom described above is divided into two trapezoids and two triangles, and the dividing lines between the trapezoids and the triangles exist on the central portion of the box bottom, there is a problem in that the area for indicating information is limited. On the other hand, by applying a seal entirely covering the outer surface to the box bottom, the indicating position can be ensured. However, the dividing lines may offset because of jolting during transportation of the packaging, so that the seal is deteriorated, and as a result, the information may become hard to read.

SUMMARY OF THE INVENTION

Therefore, an object of the present invention is to provide a flexible board for forming a package, which ensures that the area for indicating various kinds of information on the outer surface of a box bottom is improved and greater freedom of the indicating position is enabled.

According to the present invention, there is provided a flexible board for forming a package, the flexible board, developed in a plane, comprising a body portion, a big bottom piece, a small bottom piece, a left-side bottom piece, and a right-side bottom piece.

The body portion has a rear body piece, a left-side body piece, a front body piece, and a right-side body piece, which are rectangular, and which are connected to each other to form a strip shape. The big bottom piece is approximately rectangular and is connected to a lower side of the rear body piece. A vertical length of the big bottom piece is approximately equal to a horizontal length of the left-side body piece. The big bottom piece has an insert piece at a tip portion thereof. The small bottom piece is connected to a lower side of the front body piece, and has a strip piece extending along the front body piece, and first and second projecting pieces projecting from both ends of the strip piece in the opposite direction to the front body piece. The left-side bottom piece is connected to a lower side of the left-side body piece, and is formed with a first cut-out section at a portion corresponding to the first projecting piece. The right-side bottom piece is connected to a lower side of the right-side body piece, and is formed with a second cut-out section at a portion corresponding to the second projecting piece. The length of the insert piece in a direction along the rear body piece is shorter than the distance between the first and second projecting pieces.

Further, according to the present invention, there is provided a flexible board for forming a package, which has a polygonal bottom opening when assembled. The flexible board, developed in a plane, comprises a body portion, a big bottom piece, a small bottom piece, a left-side bottom piece, and a right-side bottom piece.

The body portion has a rear body piece, a left-side body piece, a front body piece, and a right-side body piece, which are connected to each other to form a strip shape. The rear body piece is positioned at a side of the polygon opposite to the front body piece in the polygon. The big bottom piece has approximately the same shape of the polygon and is connected to a lower side of the rear body piece. The big bottom piece has an insert piece at a tip portion thereof. The small bottom piece is connected to a lower side of the front body piece, and has a strip piece extending along the front body piece, and first and second projecting pieces projecting from both ends of the strip piece in the opposite direction to the front body piece. The left-side bottom piece is connected to a lower side of the left-side body piece, and is formed with a first cut-out section at a portion close to the first projecting piece. The right-side bottom piece is connected to a lower side of the right-side body piece, and is formed with a second cut-out section at a portion close to the second projecting piece. The length of the insert piece in a direction along the rear body piece is shorter than the distance between the first and second projecting pieces.

BRIEF DESCRIPTION OF THE DRAWINGS

The objects and advantages of the present invention will be better understood from the following description, with reference to the accompanying drawings in which.

DESCRIPTION OF THE PREFERRED EMBODIMENTS

Figure 1:
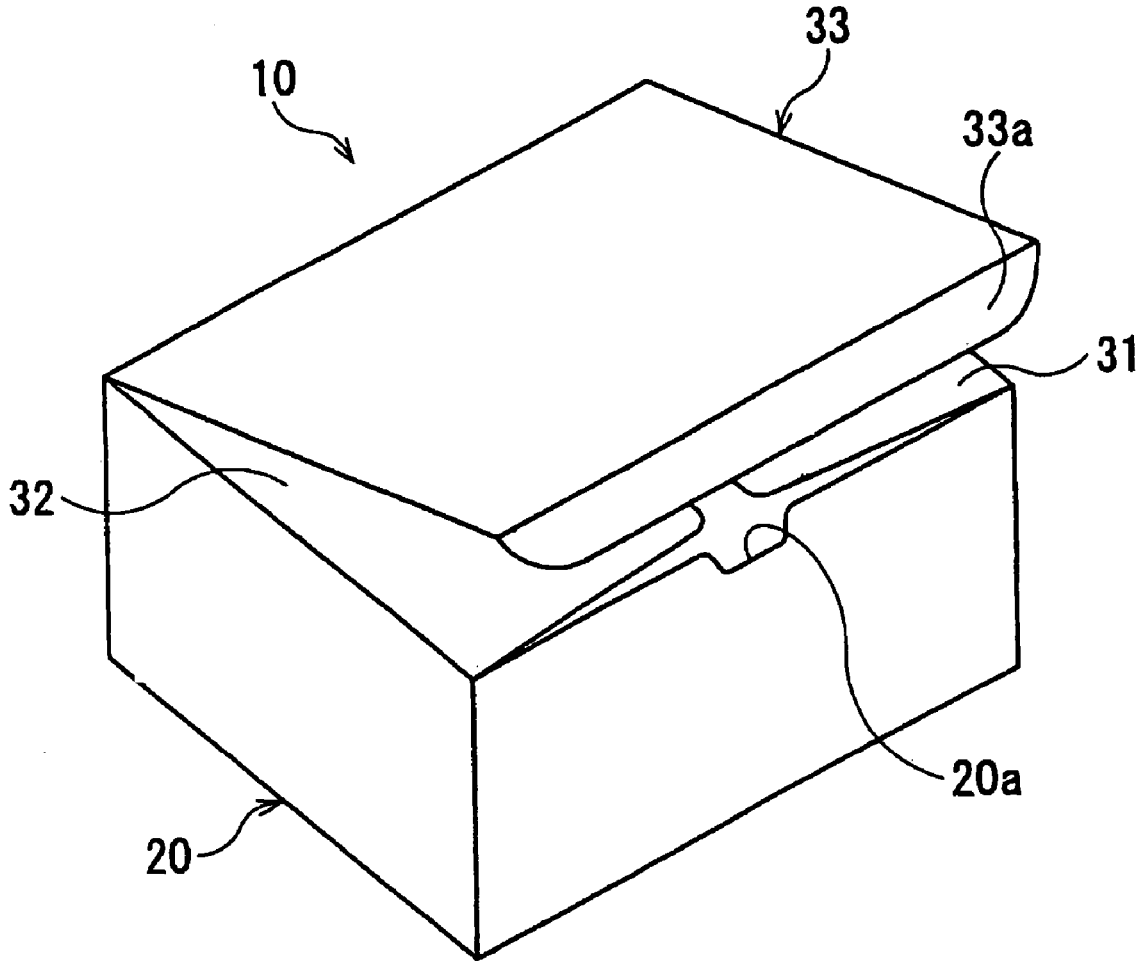
FIG. 1 is a perspective view of a package of a first embodiment of the present invention, when viewed from an upper side thereof.

The present invention will be described below with reference to an embodiment shown in the drawings.

FIG. 1 is a perspective view of a package of a first embodiment of the present invention, when viewed from an upper side thereof.

The package 10 can be used for containing a camera and an accessory thereof, for example. The package 10 is a rectangular parallelepiped structure, having a body portion 20 with four walls, a pair of side pieces 31, 32, and a lid 33 for opening and closing the upper opening of the body portion 20, and a bottom (not shown). A tip portion 33*a* of the lid 33 is folded to a side of the body portion 20, and a recess 20*a* is formed on an upper edge of a front side of the body portion 20 so that the lid 33 is easily opened.

The package 10 is obtained by folding a piece of the flexible board. The flexible board can be paper such as coated paper and cardboard, and may be a thin board made of synthetic resin.

Figure 2:
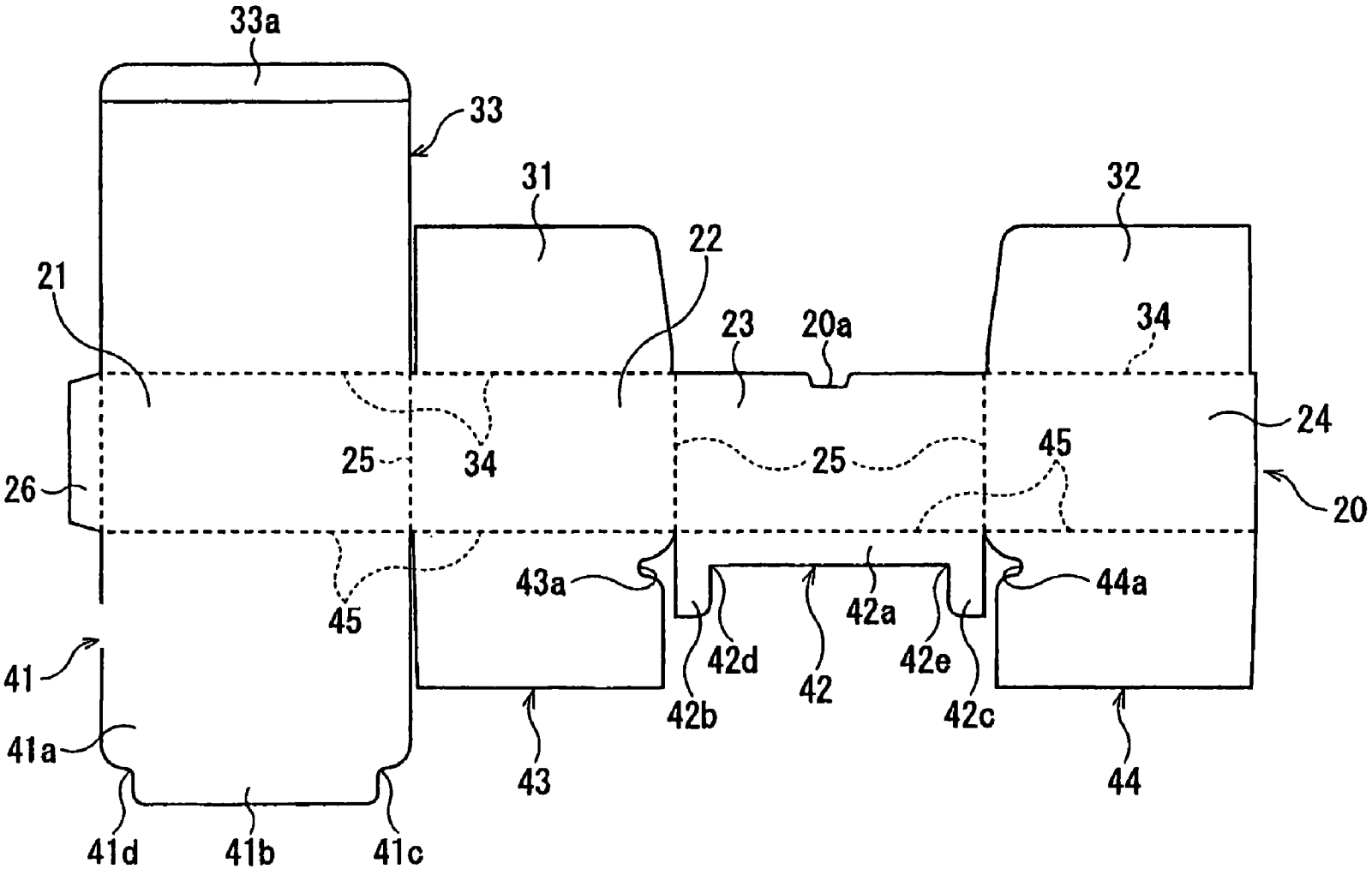
FIG. 2 is a development of the package shown in FIG. 1.

FIG. 2 shows a development view of the package 10.

The body portion 20 has a rear body piece 21, a left-side body piece 22, a front body piece 23, and a right-side body piece 24, which are rectangular, which are connected to form a strip shape. Namely, the rear body piece 21, the left-side body piece 22, the front body piece 23, and the right-side body piece 24 are approximately rectangular, and the boundaries between adjacent pieces are divided by a fold 25. A fastening flap 26 is formed on an edge of the rear body piece 21 opposite to the left-side body piece 22. By folding the folds 25 to form right angles such that the folds 25 face outside, and adhering the fastening flap 26 to an edge of the right-side body piece 24, a quadratic-prism-shape body portion 20 is formed.

A big bottom piece 41 is connected to a lower side of the rear body piece 21. The big bottom piece 41 is approximately rectangular, and a vertical length of the big bottom piece 41 is approximately equal to a horizontal length of the left-side body piece 22. The big bottom piece 41 has a main piece 41*a* for covering most of a bottom opening of the package 10, and an insert piece 41*b* formed at a tip portion of the big bottom piece 41.

A small bottom piece 42 is connected to a lower side of the front body piece 23. The small bottom piece 42 has a strip piece 42*a* extending along the front body piece 23, and first and second projecting pieces 42*b* and 42*c* projecting from both ends of the strip piece 42*a* in the opposite direction to the front body piece 23. Engaging portions 42*d* and 42*e* formed between the strip piece 42*a* and the first and second projecting pieces 42*b* and 42*c* appear to be two straight lines that intersect in FIG. 2, but actually are arc-shaped or quadrants.

A left-side bottom piece 43 is connected to a lower side of the left-side body piece 22. The left-side bottom piece 43 is approximately rectangular, and a vertical length of the left-side bottom piece 43 is approximately half the horizontal length of the front body piece 23. The left-side bottom piece 43 is formed with a first cut-out section 43*a* at a portion close to or corresponding to the first projecting piece 42*b*. The tip portion of the first cut-out section 43*a* is a semi-circle or arc-shaped.

Similarly, a right-side bottom piece 44, which is approximately rectangular, is connected to a lower side of the right-side body piece 24. A vertical length of the right-side bottom piece 44 is approximately half a horizontal length of the front body piece 23. The right-side bottom piece 44 is formed with a second cut-out section 44*a*, having a semi-circle tip portion, at a portion close to or corresponding to the second projecting piece 42*c*.

In the big bottom piece 41, the horizontal length of the insert piece 41*b* in a direction along the rear body piece 21 is shorter than the distance between the first and second projecting pieces 42*b* and 42*c*. Further, first and second arc-shaped (or quadrant) notches 41*c* and 41*d* are formed between the main piece 41*a* and the insert piece 41*b*.

The big bottom piece 41, the left-side bottom piece 43, the small bottom piece 42, the right-side bottom piece 44, and the body portion 20 are divided by folds 45. As described above, after the quadratic-prism-shape body portion 20 is formed, the flexible board is folded in such a manner that the folds 45 face outside, so that the bottom of the package 10 is formed. This forming process will be described later.

On the other hand, the lid 33 is formed on an upper side of the rear body piece 21. The side piece 31 is formed on an upper side of the left-side body piece 22, and the side piece 32 is formed on an upper side of the right-side body piece 24. The lid 33, the side pieces 31, 33, and the body portion 20 are divided by folds 34.

With reference to FIGS. 1 through 4, a forming process of the package 10 is described.

A sheet having a shape shown in FIG. 2 is stamped out from a piece of blank board. The sheet is folded at the fold 25 between the left-side body piece 22 and the front body piece 23, and the fastening flap 26 is adhered on a rear surface of the edge of the right-side body piece 24. Thus, a number of the adhered sheets can be stacked up and packaged, and carried to a place where a packing operation for goods is performed.

Figure 3:
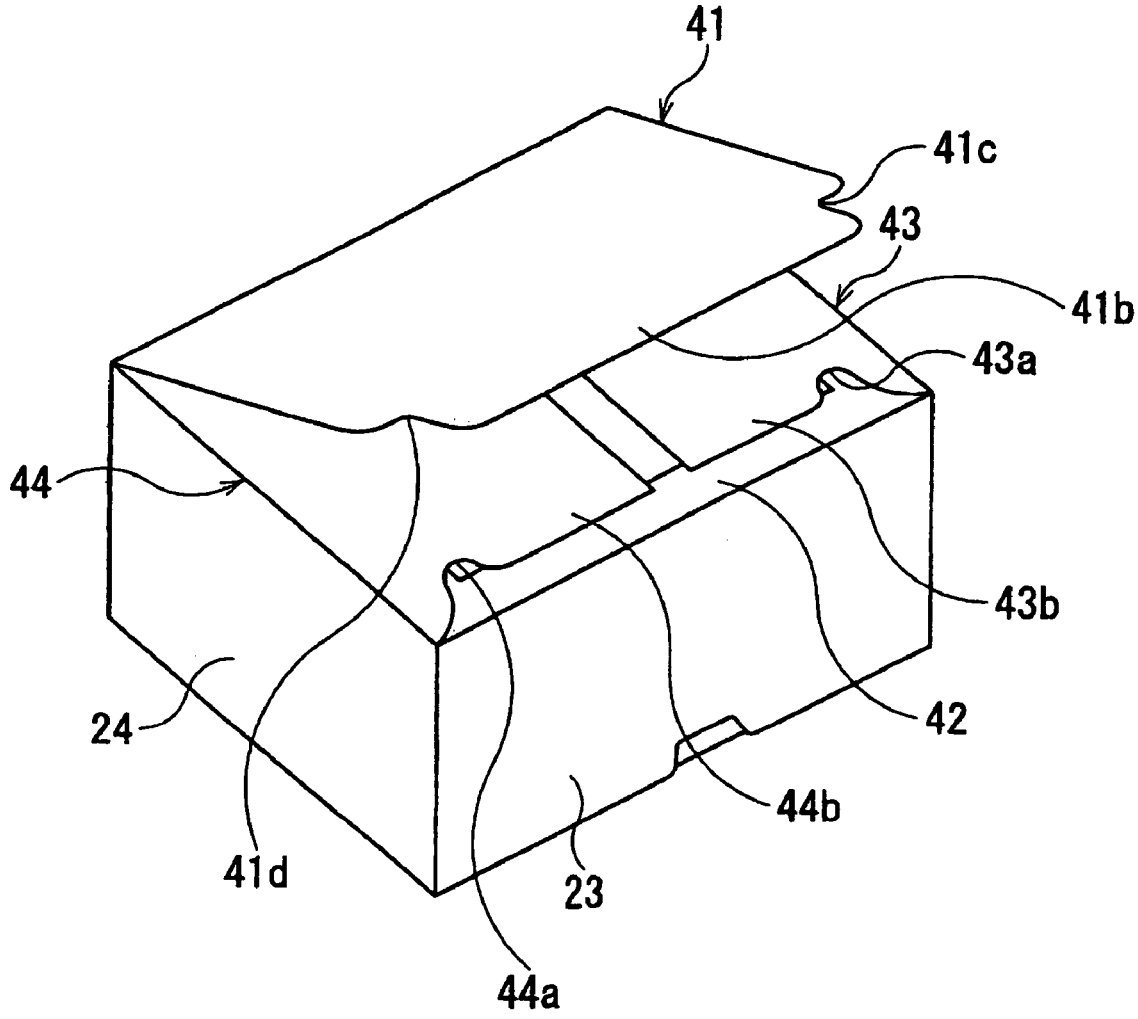
FIG. 3 is a perspective view showing a state midway through an assembling process of the package, in which the package is placed so that the bottom faces upward.

At the packing area, first, the bottom side of the sheet is turned to the upside, and is expanded so that the body portion 20 becomes a box-shape, while the small bottom piece 42 is folded inside. As shown in FIG. 3, the left-side bottom piece 43 and the right-side bottom piece 44 are then folded inside to overlap on the small bottom piece 42, and further, the big bottom piece 41 is folded in such a manner that the big bottom piece 41 covers the left-side bottom piece 43 and the right-side bottom piece 44.

Figure 4:
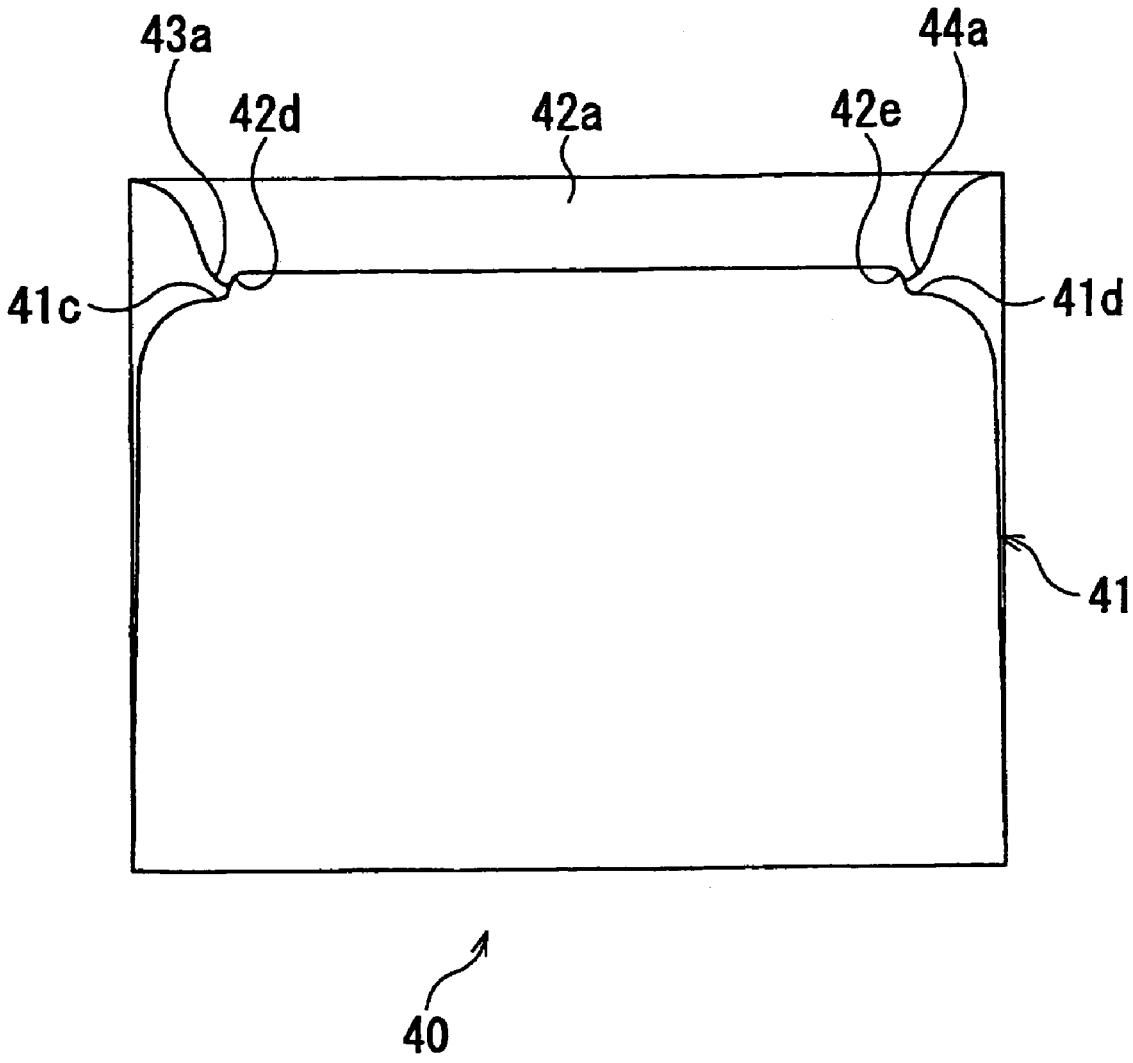
FIG. 4 is a view showing the bottom of the assembled package.

In this state, when the insert piece 41*b* of the big bottom piece 41 is depressed, the small bottom piece 42, the left-side bottom piece 43, and the right-side bottom piece 44 are largely deflected downward, so that tip portions 43*b* and 44*b* of the left-side bottom piece 43 and the right-side bottom piece 44 are slip under a lower side of the strip piece 42*a* of the small bottom piece 42. When the depressing force is then released, the small bottom piece 42, the left-side bottom piece 43, and the right-side bottom piece 44, and the big bottom piece 41 are restored, so that a bottom 40 is formed as shown in FIG. 4. Namely, the insert piece 41*b* is positioned inside the strip piece 42*a*, and the first and second projecting pieces 42*b* and 42*c* are positioned inside the left-side bottom piece 43 and the right-side bottom piece 44. Further, the notch 41*c* of the big bottom piece 41, the cut-out section 43*a* of the left-side bottom piece 43, and the engaging portion 42*d* of the small bottom piece 42 are engaged in an interlocked manner, while the notch 41*d* of the big bottom piece 41, the cut-out section 44*a* of the right-side bottom piece 44, and the engaging portion 42*e* of the small bottom piece 42 are also engaged in an interlocked manner.

As described above, according to the first embodiment, the bottom 40 is assembled only by simply depressing the big bottom piece 41, and therefore, the forming process of the package 10 is simple. Further, due to the engagement of the notch 41*c*, the cut-out section 43*a*, and the engaging portion 42*d*, and due to the engagement of the notch 41*d*, the cut-out section 44*a*, and the engaging portion 42*e*, the strength of the bottom 40 is ensured, the packed goods are securely held in the package 10. Furthermore, since the tip portions of the left-side bottom piece 43 and the right-side bottom piece 44 are close to each other to cover the whole of the bottom 40, the bottom 40 will not break because of the weigh, even if the packed goods are the weight of a medium-size camera for example.

Since the main piece 41*a* of the big bottom piece 41 has a size which is large enough to cover most of the bottom opening of the package 10, information regarding the goods packed in the package 10 can be freely printed on the bottom 40 without being divided by a division line formed on the bottom in a conventional package. Further, even when a seal, on which such information is printed, is applied on the bottom 40, the area where the seal is applied does not include a division line. Thus, a seal greater than a conventional one can be applied on the bottom 40, and the degree of freedom with which the seal is applied is improved. The seal can be applied not only to the main piece 41*a*, but also to the rear body piece 21. Accordingly, one seal can be applied over both the rear body piece 21 and the main piece 41*a*, and thus, a printing process for the seal becomes simpler in comparison with a case in which a plurality of seals are separately applied to the package 10.

Note that, although the notches 41*c* and 41*d*, the cut-out sections 43*a* and 44*a*, and the engaging portions 42*d* and 42*e* are arc-shaped in the embodiment, these can be replaced with curved lines, and are not limited to arc shape. Further, when the sheet material has sufficient strength, such as cardboard or plastic material, the notches 41*c* and so on need not be formed in a curved line.

The present invention can be applied to a case in which the rear body piece 21 and the front body piece 23 are changed with each other, in the first embodiment. In this case, the big bottom piece 41 is placed between the left-side bottom piece 43 and the right-side bottom piece 44, and the small bottom piece 42 is placed on a left side of the left-side bottom piece 43. Therefore, the first cut-out section 43*a* is formed on a left side of the left-side bottom piece 43, i.e., a position corresponding to the first projecting piece, and the second cut-out section 44*a* is formed on a right side of the right-side bottom piece 44, i.e., a position corresponding to the second projecting piece.

Figure 5:
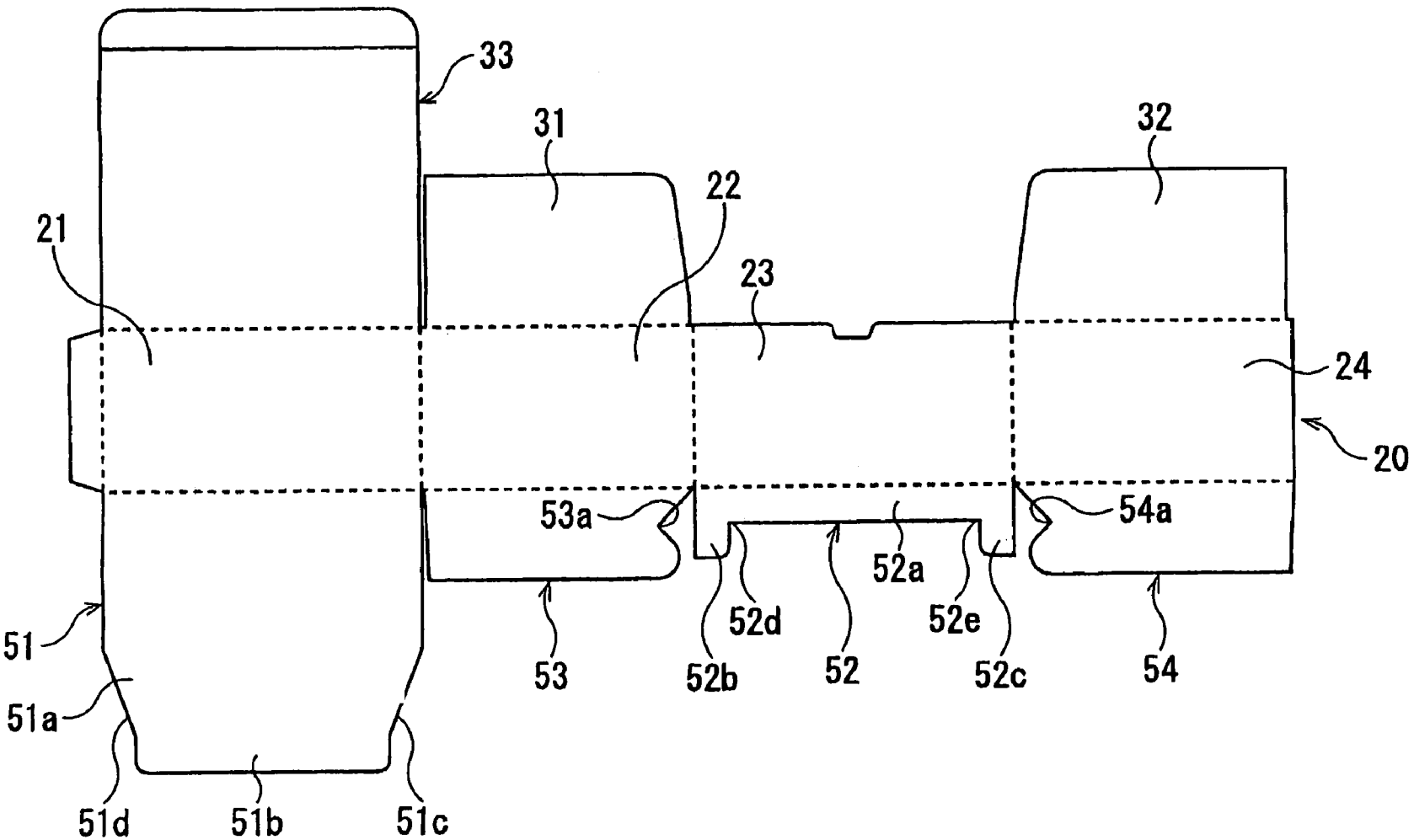
FIG. 5 is a development of the package of a second embodiment of the present invention.

FIG. 5 is a development of the package of a second embodiment of the present invention, and the basic structure is the same as that of the first embodiment. The differences from the first embodiment are the shapes of a big bottom piece 51, a small bottom piece 52, a left-side bottom piece 53, and a right-side bottom piece 54.

Namely, in the big bottom piece 51, portions 51*d* and 51*e* of a main piece 51*a*, close to an insert piece 51*b*, linearly taper off, and notches are not formed on the connecting portion to the insert piece 51*b*. Further, cut-out sections 53*a* and 54*a* formed on the left-side bottom piece 53 and the right-side bottom piece 54 are not semicircular, but are right-angled corners. The small bottom piece 52 has approximately the same shape as that in the first embodiment, and has strip piece 52*a*, and first and second projecting pieces 52*b* and 52*c*. In the small bottom piece 52, however, engaging portions 52*d* and 52*e* are not quadrants, but are right-angled corners. On the other hand, vertical lengths of the left-side bottom piece 53 and the right-side bottom piece 54 are slightly greater than those of the first and second projecting pieces 52*b* and 52*c* of the small bottom piece 52, and are approximately a quarter of the horizontal length of the front bottom piece 23.

The other structures are the same as those of the first embodiment, and the assembling process is also the same.

According to the second embodiment, in comparison with the first embodiment, discrepancies or offsetting among each of the pieces can be reduced, and the package can be formed with a high accuracy. Further, in the second embodiment, when an edge of the bottom piece catches on something, the problem of the edge rolling up hardly occurs. However, since the strength of the package may not be superior depending upon the size of the package, material such as cardboard and plastic, having sufficient strength, is preferably used for the sheet.

Figure 6:
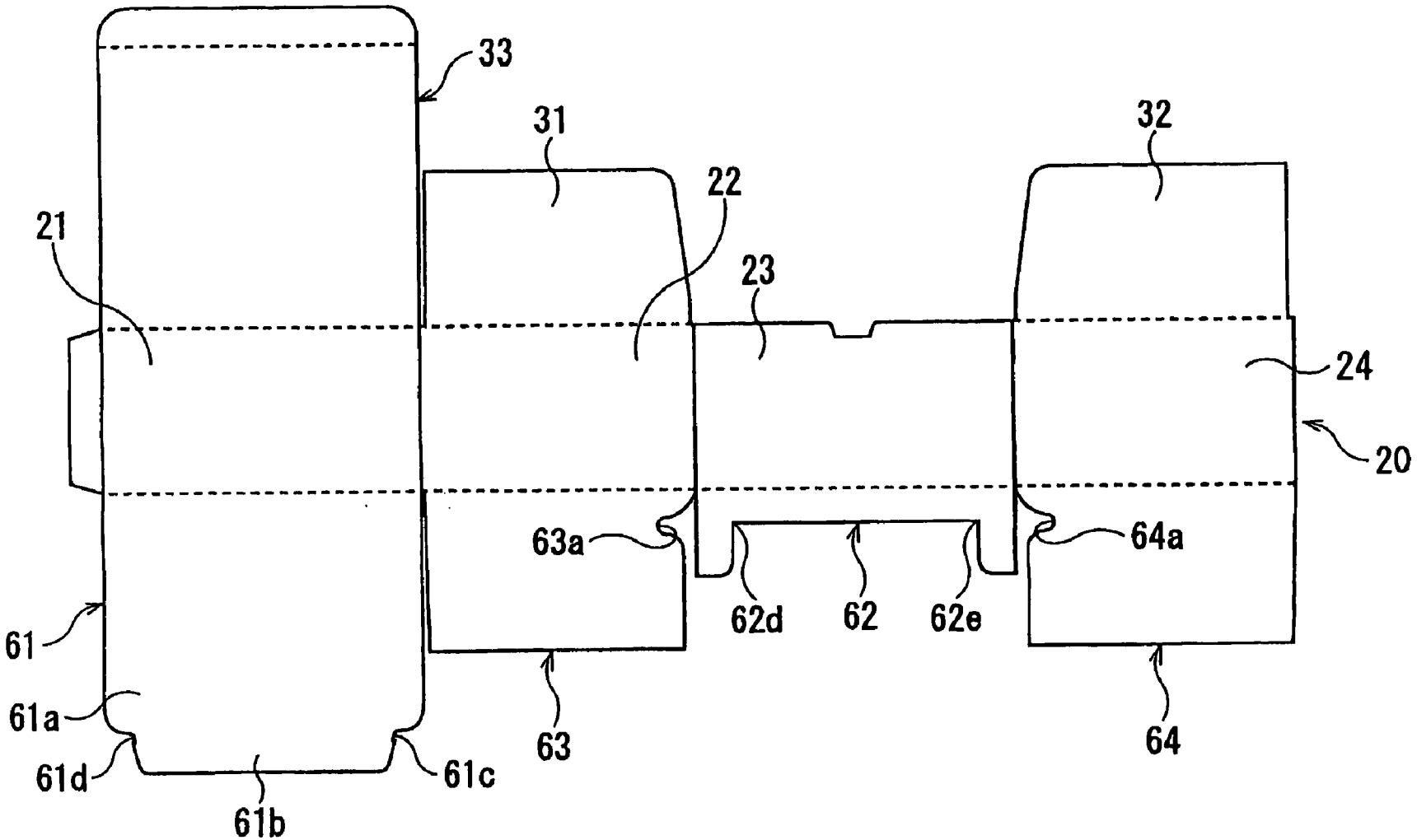
FIG. 6 is a development of the package of a third embodiment of the present invention.
Figure 7:
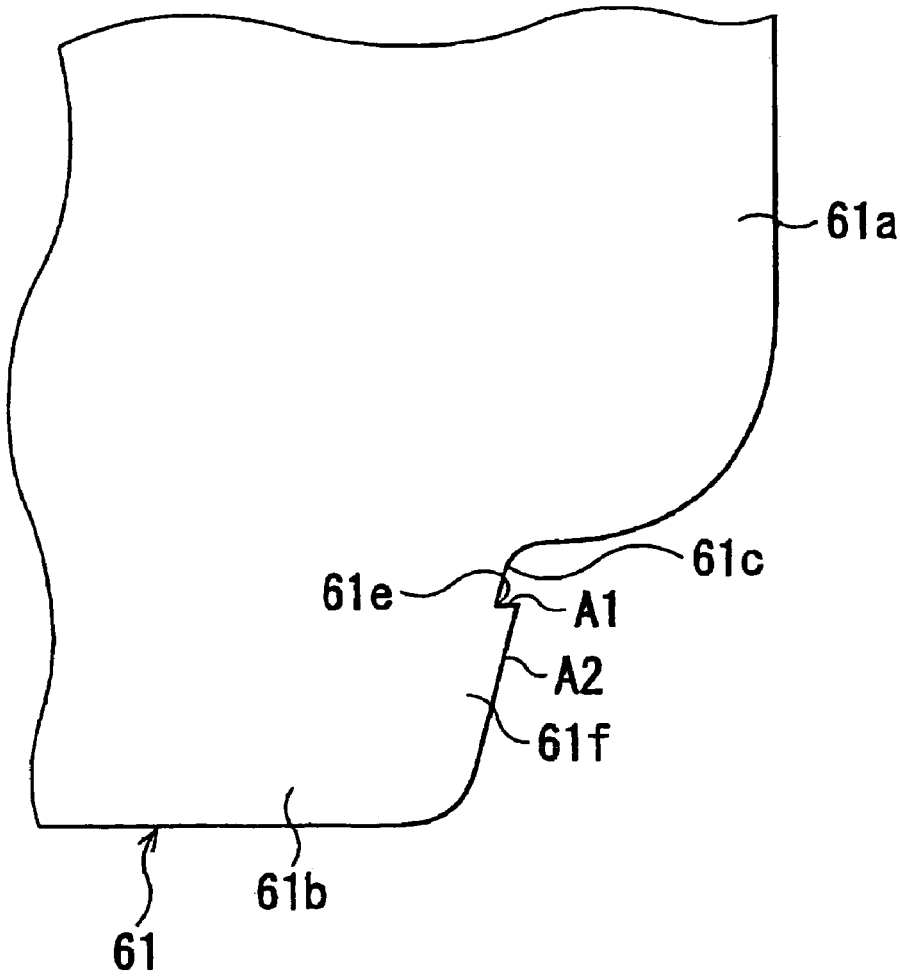
FIG. 7 is an enlarged view showing a third notch formed in the package of FIG. 6.

FIG. 6 is a development of the package of a third embodiment of the present invention. The basic structure is basically the same as that of the first embodiment, however, the difference from the first embodiment is a shape of a big bottom piece 61. More specifically, the big bottom piece 61 has a main piece 61*a*, for covering most of a bottom opening of the package, and an insert piece 61*b*, and further, a third notch 61*c* is provided between the main piece 61*a* and the insert piece 61*b*. The third notch 61*c* is formed, as shown in FIG. 7, in such a manner that a notch 61*e* having an acute angle is provided at a position corresponding to the notch 41*c* of the first embodiment (see FIG. 2). Namely, the third notch 61*c* is formed such that an engaging claw 61*f*, projecting along the longitudinal direction of the insert piece 61*b* (or in a direction parallel to the rear body piece 21), is formed at the end portion of the insert piece 61*b*. A contour of the engaging claw 61*f* contains two straight lines A1 and A2 intersecting at an angle smaller than a right angle. The other structures are the same as those of the first embodiment.

According to the third embodiment, at the bottom of the package, an engaging strength among the notch 61*c*, a cut-out section 63*a* of a left-side bottom piece 63, and an engaging portion 62*d*, and an engaging strength among the notch 61*d*, a cut-out section 64*a* of a right-side bottom piece 64, and an engaging portion 62*e*, are increased, so that heavier goods can be held than with the first embodiment.

Figure 8:
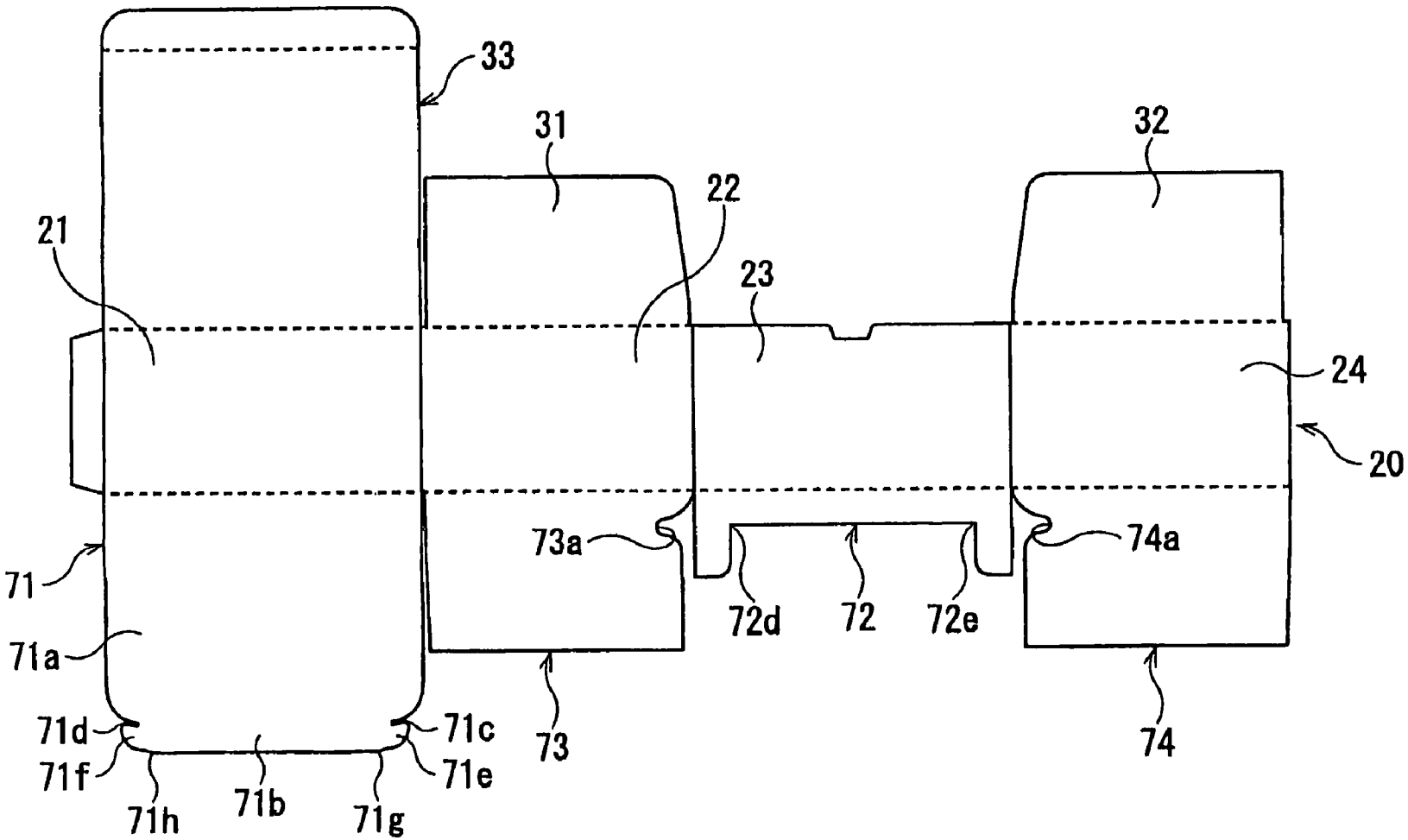
FIG. 8 is a development of the package of a fourth embodiment of the present invention.

FIG. 8 is a development of the package of a fourth embodiment of the present invention. Similarly to the third embodiment, the difference from the first embodiment is a shape of a big bottom piece 71. Namely, in the big bottom piece 71, third notches 71*c* and 71*d* are provided between a main piece 71*a* and an insert piece 71*b*, to form engaging claws 71*e* and 71*f*. The third notches 71*c* and 71*d* are deeper in comparison with the third embodiment, and a contour of each of the engaging claws 71*e* and 71*f* is curve as a whole. The contour has recesses 71*g* and 71*h*, which are formed in positions opposite to the third notches 71*c* and 71*d*, and are shallower than the third notches 71*c* and 71*d*.

According to the fourth embodiment, similarly to the third embodiment, at the bottom of the package, an engaging strength among the notch 71*c*, a cut-out section 73*a* of a left-side bottom piece 73, and an engaging portion 72*d*, and an engaging strength among the notch 71*d*, a cut-out section 74*a* of a right-side bottom piece 74, and an engaging portion 72*e*, are increased, so that heavier goods can be held than the first embodiment. Further, by providing the shallow recesses 71*g* and 71*h*, the insert piece 71*b* can be snapped under the small bottom piece 72 smoothly, depending upon the material of the package (for example, when the thickness of the material is relatively great).

Figure 9:
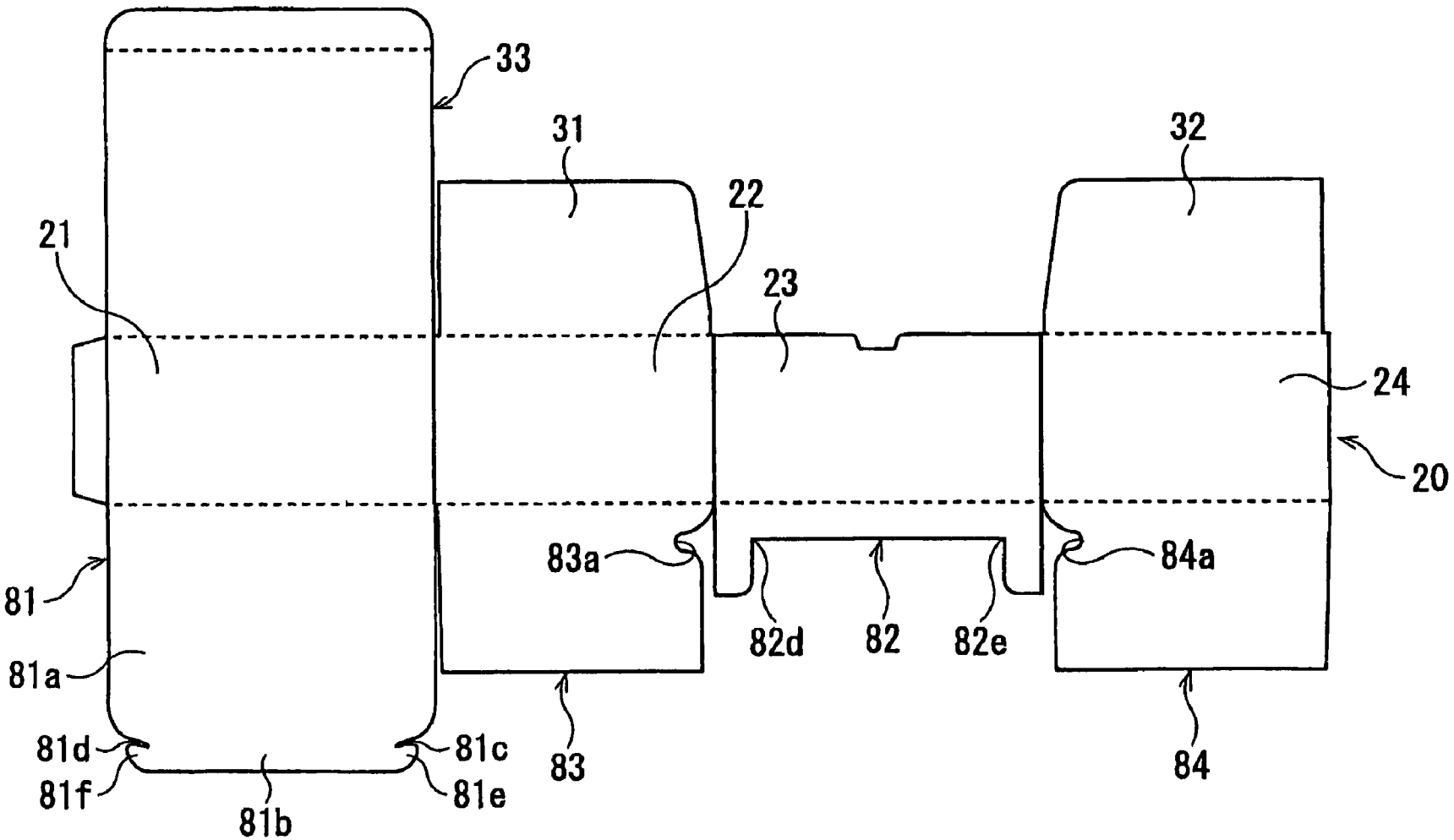
FIG. 9 is a development of the package of a fifth embodiment of the present invention.

FIG. 9 is a development of the package of a fifth embodiment of the present invention. Similarly to the third embodiment, the difference from the first embodiment is a shape of a big bottom piece 81. Namely, in the big bottom piece 81, third notches 81*c* and 81*d* are provided between a main piece 81*a* and an insert piece 81*b*, to form engaging claws 81*e* and 81*f*. The third notches 81*c* and 81*d* are deeper in comparison with the third embodiment, and a contour of each of the engaging claws 81*e* and 81*f* is curved as a whole. A shallow recess is not formed, which is different from the fourth embodiment.

According to the fifth embodiment, similarly to the third embodiment, at the bottom of the package, an engaging strength among the notch 81*c*, a cut-out section 83*a* of a left-side bottom piece 83, and an engaging portion 82*d*, and an engaging strength among the notch 81*d*, a cut-out section 84*a* of a right-side bottom piece 84, and an engaging portion 82*e*, are increased, so that heavier goods can be held than in the first embodiment.

Figure 10:
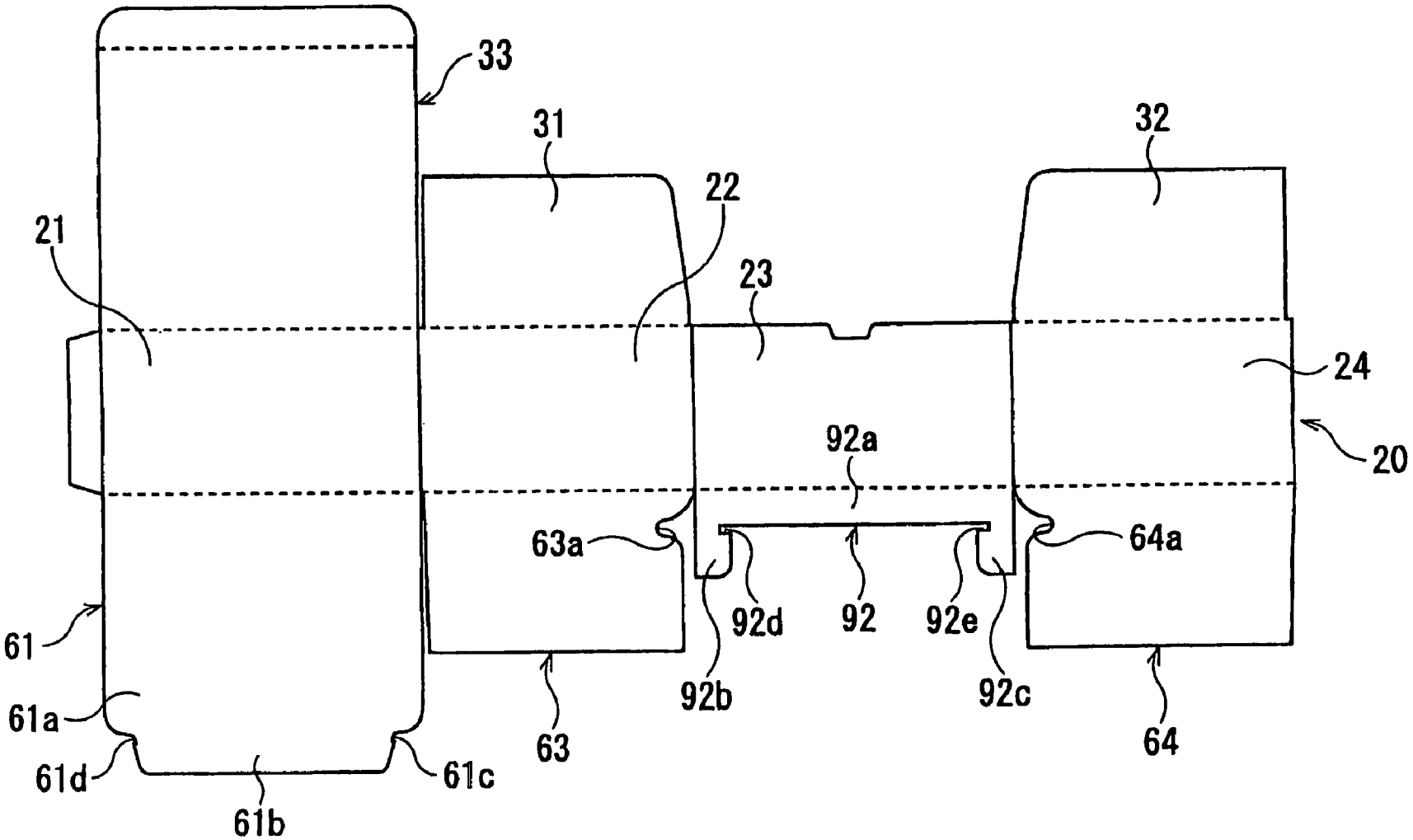
FIG. 10 is a development of the package of a sixth embodiment of the present invention.

FIG. 10 is a development of the package of a sixth embodiment of the present invention. The basic structure is the same as that of the third embodiment, and the difference from the third embodiment is a shape of a small bottom piece 92. Namely, in the small bottom piece 92, first and second projecting pieces 92*b* and 92*c* project from both ends of a strip piece 92*a* in the opposite direction to the front body piece 23. Engaging portions 92*d* and 92*e* formed between the strip piece 92*a* and the first and second projecting pieces 92*b* and 92*c* are rectangular notches. The other structures are the same as those of the third embodiment.

According to the sixth embodiment, similarly to the third embodiment, at the bottom of the package, an engaging strength among the notch 61*c*, the cut-out section 63*a* of the left-side bottom piece 63, and the engaging portion 92*d*, and an engaging strength among the notch 61*d*, the cut-out section 64*a* of the right-side bottom piece 64, and the engaging portion 92*e*, are increased, so that heavier goods can be held than in the first embodiment.

Figure 11:
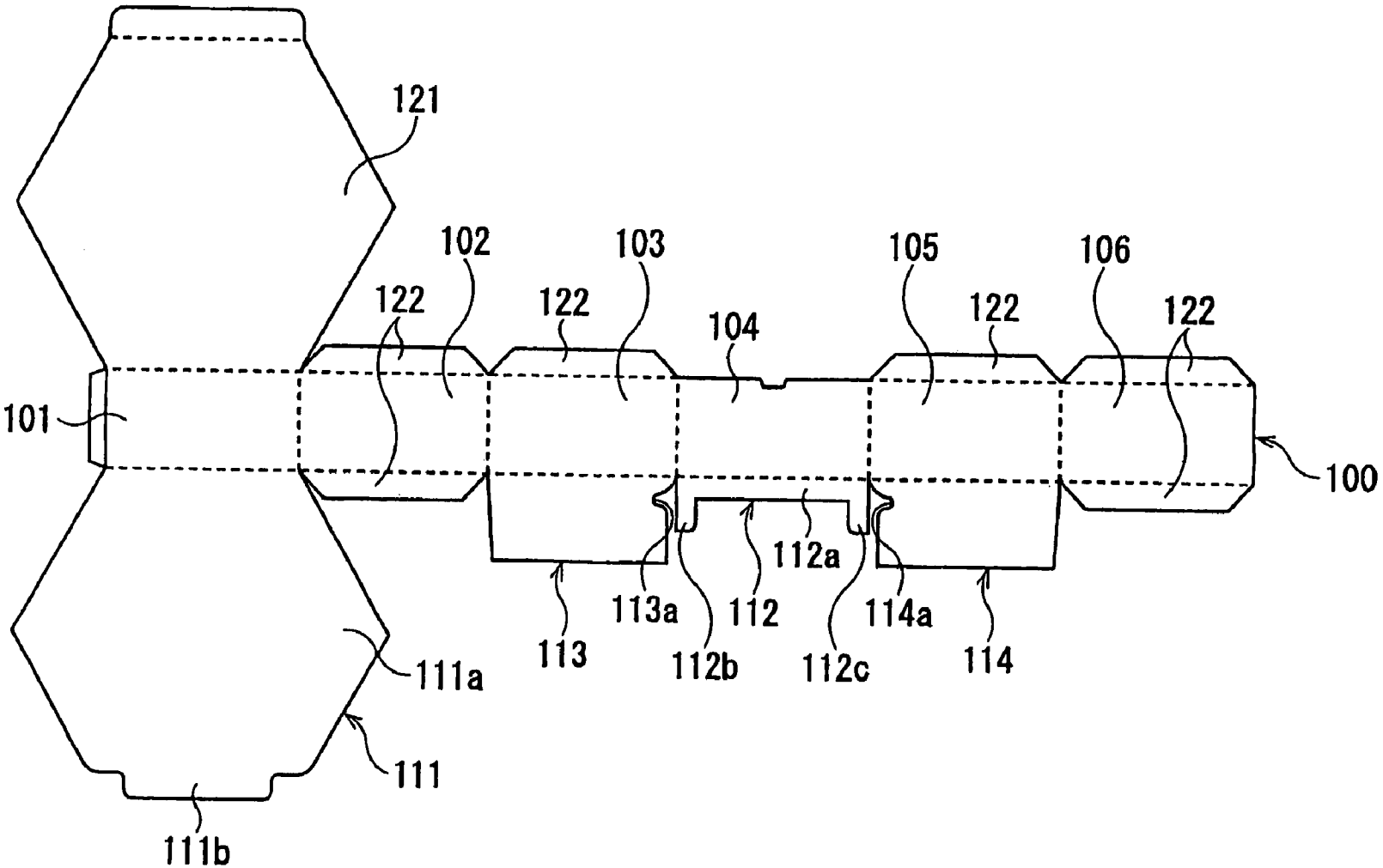
FIG. 11 is a development of the package of a seventh embodiment of the present invention.

FIG. 11 is a development of the package of a seventh embodiment of the present invention.

The package has a hexagonal bottom opening when assembled. Namely, a body portion 100 has a rear body piece 101, first and second left-side body pieces 102, 103, a front body piece 104, and first and second right-side body pieces 105, 106. The rear body piece 101 is located at a side facing the front body piece 104 with respect to the hexagon. The horizontal lengths of these pieces 101 through 106 are identical.

A big bottom piece 111 has a main piece 111*a* having approximately the same shape as the opening, and an insert piece 111*b* is formed at a tip portion of the big bottom piece 111. A small bottom piece 112 has the same shape as that of the first embodiment, having a strip piece 112*a*, and first and second projecting pieces 112*b*, 112*c*. A left-side bottom piece 113 is connected to a lower side of the second left-side body piece 103, which is adjacent to the left-side of the front body piece 104. A first cut-out section 113*a* is formed in a portion adjacent to the first projecting piece 112*b*. A right-side bottom piece 114 is connected to a lower side of the first right-side body piece 105, which is adjacent to the right-side of the front body piece 104. A second cut-out section 114*a* is formed in a portion adjacent to the second projecting piece 112*c*. A length of the insert piece 111*b*, in a direction along the rear body piece 101, is shorter than the distance between the first and second projecting pieces 112*b* and 112*c*.

A hexagon lid 121, which has the same shape as the opening, is connected to the upper side of the rear body piece 110. Auxiliary pieces 122 are connected to the upper and lower sides of the first left-side body piece 102, an upper side of the second left-side body piece 103, an upper side of the first right-side body piece 105, and upper and lower sides of the second right-side body piece 106. The shapes of the auxiliary pieces 122 can be freely set, and may be expanded to a larger size when the strength of the bottom is required to be improved.

The other structures are identical with the first and second embodiments. The assembling operation is also identical with that of the first and second embodiments, and the description thereof is omitted.

As understood from the seventh embodiment, the present invention is not limited to a package which has a rectangular opening, and can be applied to a package which has an opening shaped like a regular polygon, which has an even number of sides, such as regular hexagon. However, even in the case of a polygon having an odd number of sides, the present invention can be applied to a package, so long as the rear body piece is located at a side which faces the front body piece.

Although the package is assembled by folding one piece of flexible board in the above embodiments, the flexible board can be obtained by connecting or adhering two pieces of flexible board.

Although the embodiments of the present invention have been described herein with reference to the accompanying drawings, obviously many modifications and changes may be made by those skilled in this art without departing from the scope of the invention.

The present disclosure relates to subject matters contained in Japanese Patent Application Nos. 2005-021862 (filed on Jan. 28, 2005) and 2005-290054 (filed on Oct. 3, 2005) which are expressly incorporated herein, by reference, in their entirety.

The invention claimed is:

1. A flexible board for forming a package, said flexible board, developed in a plane, comprising:

a body portion that has a rear body piece, a left-side body piece, a front body piece, and a right-side body piece, which are rectangular, and which are connected to each other to form a strip shape;

a big bottom piece that is approximately rectangular and is connected to a lower side of said rear body piece, a vertical length of said big bottom piece being approximately equal to a horizontal length of said left-side body piece, said big bottom piece having an insert piece at a tip portion thereof;

a small bottom piece that is connected to a lower side of said front body piece, and that has a strip piece extending along said front body piece, and first and second projecting pieces projecting from both ends of said strip piece in the opposite direction to said front body piece;

a left-side bottom piece that is connected to a lower side of said left-side body piece, and that is formed with a first cut-out section at a portion corresponding to said first projecting piece; and a right-side bottom piece that is connected to a lower side of said right-side body piece, and that is formed with a second cut-out section at a portion corresponding to said second projecting piece;

the length of said insert piece in a direction along said rear body piece being shorter than the distance between said first and second projecting pieces, and a vertical length of each of said left-side and right-side bottom pieces being approximately half a horizontal length of the front body piece.

2. A flexible board according to claim 1, wherein said big bottom piece comprises a main piece, for covering most of a bottom opening of said package, first and second arc-shaped notches being formed between said main piece and said insert piece.

3. A flexible board according to claim 1, wherein said big bottom piece comprises a main piece, for covering most of a bottom opening of said package, and a third notch is formed between said main piece and said insert piece such that an engaging claw, projecting in a direction parallel to said rear body piece, is formed at the end portion of said insert piece.

4. A flexible board according to claim 3, wherein said engaging claw comprises a contour, containing two straight lines intersecting at an angle smaller than a right angle.

5. A flexible board according to claim 3, wherein said engaging claw comprises a contour, which is curved as a whole.

6. A flexible board according to claim 3, wherein said engaging claw comprises a contour, which has a recess formed in the opposite position to said third notch.

7. A flexible board according to claim 1, wherein an arc-shaped engaging portion is formed between said strip piece and said first and second projecting pieces.

8. A flexible board according to claim 1, wherein said first and second cut-out sections are arc-shaped.

9. A flexible board according to claim 1, wherein, when said flexible board is assembled into said package, said insert piece is positioned inside said strip piece, and said first and second projecting pieces are positioned inside said left-side and right-side bottom pieces.

* * * * *